United States Patent [19]

Dumazy et al.

[11] Patent Number: 4,741,647

[45] Date of Patent: May 3, 1988

[54] GUIDE TUBE FOR A FLEXIBLE UPRIGHT RISER FOR MARINE PETROLEUM EXPLOITATION

[75] Inventors: Christian Dumazy, Bizanos; François Baduel, Tarbes; Jean-Paul Sarrailh, Pau, all of France

[73] Assignee: Societe Nationale Elf Aquitaine (Production), Courbevoie, France

[21] Appl. No.: 871,914

[22] Filed: Jun. 9, 1986

[30] Foreign Application Priority Data

Jun. 10, 1985 [FR] France ..... 85 08724

[51] Int. Cl.[4] ..... E02B 17/00

[52] U.S. Cl. ..... 405/202; 405/195

[58] Field of Search ..... 405/195, 202; 166/350, 166/359, 367

[56] References Cited

U.S. PATENT DOCUMENTS

| | | | |
|---|---|---|---|
| 3,557,564 | 1/1971 | Hauber | 166/359 |
| 3,677,016 | 7/1972 | Garrigus | 405/202 |
| 3,739,592 | 6/1973 | Plake | 166/359 |
| 4,181,453 | 1/1980 | Vache | 405/195 |
| 4,273,470 | 6/1981 | Blomsma et al. | 405/202 |
| 4,441,839 | 4/1984 | Baduel et al. | 405/202 |
| 4,470,723 | 9/1984 | Michel et al. | 405/202 |
| 4,482,274 | 11/1984 | Brandi et al. | 405/195 |
| 4,566,824 | 1/1986 | Minier et al. | 405/202 |

FOREIGN PATENT DOCUMENTS

| | | |
|---|---|---|
| 2307949 | 4/1975 | France . |
| 2513305 | 9/1981 | France . |

*Primary Examiner*—Randolph A. Reese
*Assistant Examiner*—Anthony Knight
*Attorney, Agent, or Firm*—Oblon, Fisher, Spivak, McClelland & Maier

[57] ABSTRACT

A stress-limiting device for a flexible riser which stress-limiting device glides in a set of guides rigidly attached to an articulated structure emplaced in the deep sea. The device includes an elastic guide tube element coaxial to the riser, with the stiffness of the guide tube increasing progressively from the top to the bottom of said guide tube, whereby the stiffness characteristic is appreciable in the lower region of the guide tube, which lower region is affixed to a structure attached to a wellhead or the like via an aligned fitting, whereby the guide tube is held in contact with the riser by the intermediary of a plurality of support mechanisms one of which includes a fitted bushing which glides in the lower, rigid part of the guide tube. The device makes it possible to shut down and resume operation of offshore wells which have been equipped for production.

5 Claims, 4 Drawing Sheets

GUIDE TUBE FOR A FLEXIBLE UPRIGHT RISER FOR MARINE PETROLEUM EXPLOITATION

BACKGROUND OF THE INVENTION

1. Field of the Invention

The present invention relates to an improvement in flexible risers connected to an articulated structure emplaced in deep water for underwater operations, particularly for petroleum extraction.

2. Description of the Prior Art

In Fr. Pat. No. 2,307,949 assigned to the assignee of this application, a riser for an articulated structure for deep-water petroleum extraction is described. Such riser is eccentrically disposed with respect to the articulated structure and is connected to a head pipe by a joint which is equivalent to an aligned fitting, and is supported against the interior wall of the well guide. The result is that the zone where the maximum stresses are applied when the articulated structure oscillates is localized between the sliding piston (which may be considered as a translationally mobile aligned fitting) and the fitting on the head pipe. A device for areal application of stresses to the riser enables buckling stresses to be reduced.

While fatigue is manifested solely on the lower element, it has been found that with the substantial eccentricity of the arrangement there can be substantial deformation of that element, with serious consequences for the behavior of said element. To alleviate these problems, in Fr. Pat. No. 2,513,305 also assigned to the assignee of the present application, a mechanical guiding device is proposed for said lower element, which device employs an articulated parallelogram system having the effect of subjecting said lower element to the same stresses as those to which a riser disposed along the axis of the articulated structure would be subjected.

Although this mechanical device does have advantages, greater attention needs to be given to continuous functioning of the areal stressing means. The slightest error in operation of these stressing means gives rise to a hazard of buckling, over the riser as a whole and particularly in its lower element—to the extent that a rupture can become inevitable.

SUMMARY OF THE INVENTION

To alleviate these problems, it is proposed according to the invention to dispose the lower element of the riser in a coaxial elastic guide tube, against which tube said lower element is supported.

The stress-limiting device according to the invention, for a riser, wherein said riser is an extension of a pipe rigidly attached to a base plate, whereby said riser glides in a set of guides rigidly attached to an articulated structure emplaced in deep water, and the lower part of said riser is flexible. The inventive device comprises an elastic guide tube element the lower part of which is furnished with means which provide substantial rigidity, said guide tube element being affixed by an aligned fitting to a structure attached to the base plate. The guide tube is supported in the lower guide of the set of guides rigidly attached to the articulated structure, and is disposed exteriorly of and coaxially to the riser, which riser is supported against said guide tube by means of a plurality of supports the bottommost of which comprises a fitted bushing which glides in the lower, rigid part of this guide tube.

According to a preferred embodiment, a stress-limiting device according to the invention, for a riser, which riser is an extension of a pipe rigidly attached to a base plate, whereby said riser glides in a set of guides rigidly attached to an articulated structure emplaced in deep water, and the lower part of said riser is flexible. The inventive device comprises an elastic guide tube element the lower part of which is furnished with means which provide substantial rigidity, said guide tube element being affixed by an aligned fitting to a structure attached to the base plate of the set of guides rigidly attached to the articulated structure, and being disposed exteriorly of and coaxially to the riser, which riser is supported against said guide tube by means of a plurality of supports the bottommost of which is a fitted bushing which glides in the lower, rigid part of said guide tube; and said inventive device further comprises another means of support in the region where the guide tube is supported against the lower guide of the said set of guides rigidly attached to the articulated structure.

In embodiments wherein it is desired to localize the lower, flexible part of the riser between two aligned fittings, the means of support, by which the riser is supported against the guide tube in the region where this guide tube is supported against the lower guide of the said set of guides rigidly attached to the articulated, structure comprise a fitted gliding bushing.

Preferably the means which provide substantially rigidity to the lower part of the elastic guide tube comprise a thickening of the metal with respect to the thickness in the upper part.

Where the guide tube is of a short type, such must still be long enough that it is supported against the lower guide of the set of guides rigidly attached to the articulated structure, independent of the angle of inclination of the articulated structure. Where the guide tube is of a long type, it is extended up to the upper end of the riser, and is supported, by support means, against guides rigidly attached to the articulated structure, and in turn supports the riser by support means.

In certain embodiments, a plurality of concentric flexible risers is disposed interiorly of the guide tube.

In certain embodiments the base plate comprises the support for a wellhead comprising at least one casing, whereby the lower end of the guide tube is affixed to the reinforced end of said casing by means of an aligned fitting.

In other embodiments, the base plate comprises anchoring means whereby a submarine conduit is anchored to the marine bottom, whereby the guide tube is then connected directly to said base plate by an aligned fitting.

BRIEF DESCRIPTION OF THE DRAWINGS

The invention will be described in more detail hereinbelow with reference to various embodiments illustrated with the aid of the drawings; wherein it is understood that these embodiments do not limit the scope of the invention.

DETAILED DESCRIPTION OF THE PREFERRED EMBODIMENTS

Figure 1:
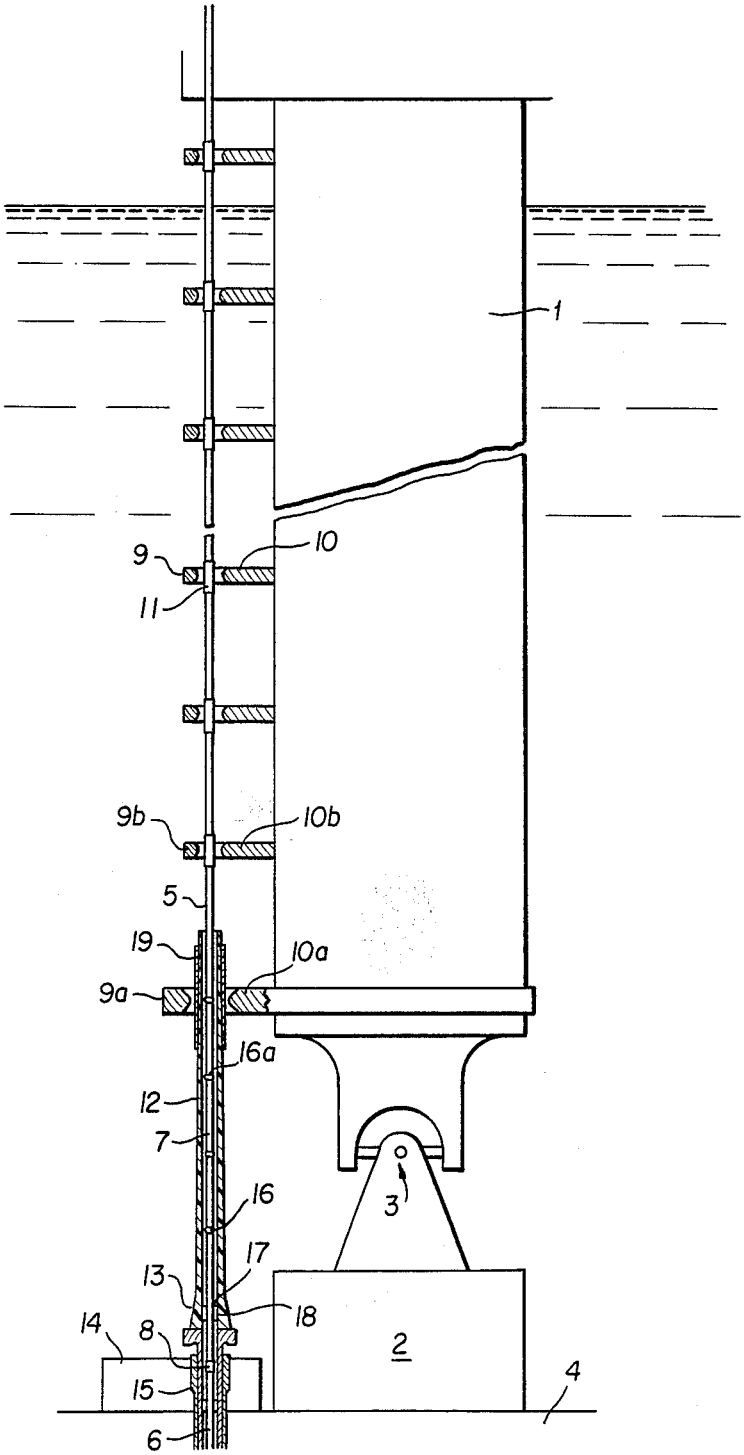
FIG. 1 shows an installation with a short guide tube.
Figure 3:
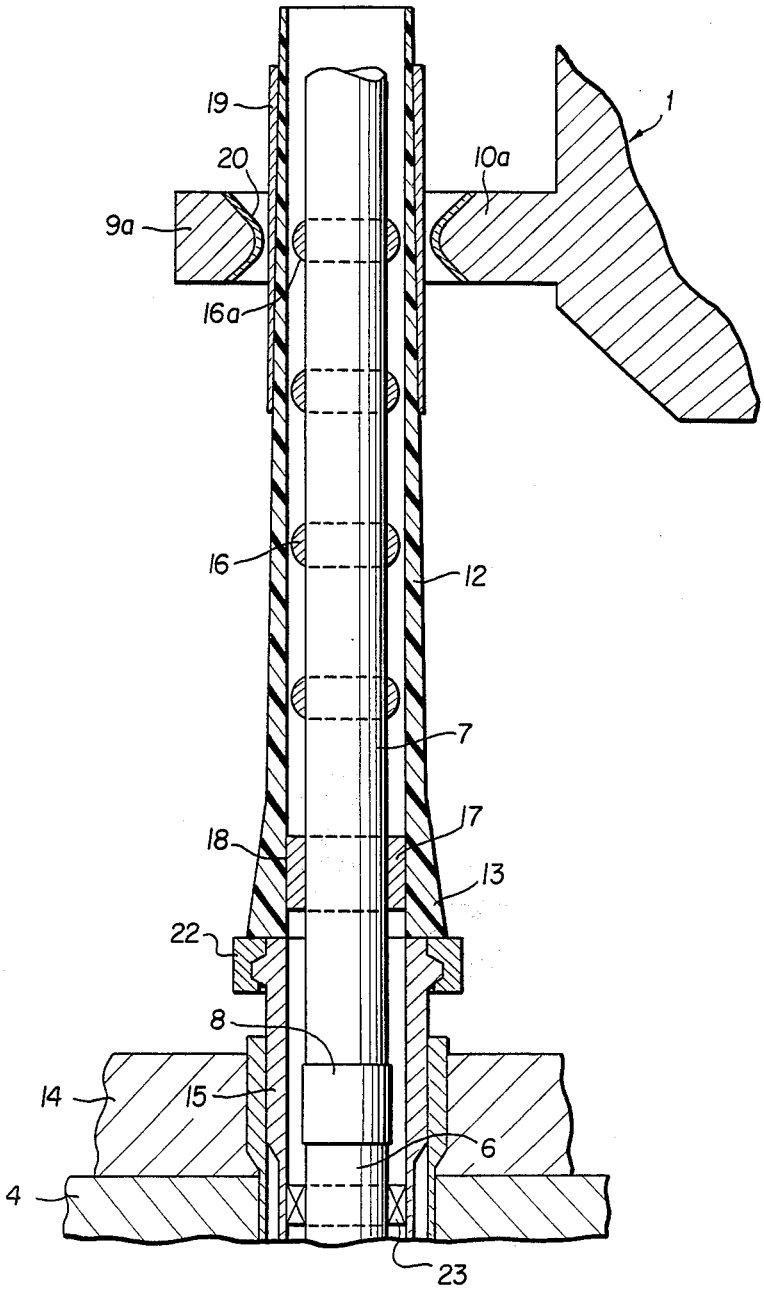
FIG. 3 shows the detail of the installation of FIG. 1.

FIG. 1 and the detailed view in FIG. 3, an articulated structure 1 is shown schematically, which structure rests on a base 2 by means of a universal joint 3, e.g. a cardan joint. The base 2 is affixed to the marine bottom 4 by known means not shown.

The articulated structure 1 is employed as a support for one or more upright risers such as riser 5, which provides a connection between a conduit 6 which is dependent on an installation connected to the marine bottom 4, and an elevated evacuation conduit (not shown).

Such a riser 5, comprised of elements of production pipes interconnected by joints, itself comprises a lower, flexible part 7 connected to the production conduit or pipe 6 by means of a threaded fitting 8 which fitting is maneuverable from the surface to provide connection or disconnection (i.e., a "tie back").

The riser 5 is translatably movable interiorly to a set of spaced guides (9, 9*a*, 9*b*, etc.) which are rigidly attached to the articulated column by means of a set of supports (10, 10*a*, 10*b*, etc.). The translational mobility of riser 5 is assured by a plurality of bushings (e.g., 11) affixed to the column and contacting the interior walls of the guides (i.e., 9, 9*a*, 9*b*, etc.).

The lower, flexible part 7 of riser 5 in FIG. 1 is disposed inerior to an elastic guide tube 12 coaxial with it. This guide tube 12 is affixed by a fitting which serves to amount the guide tube lower extremity 13 on a base structure 14 attached to a wellhead 15 or the like, which structure 14 is, e.g. a base plate affixed to the marine bottom 4.

The elastic guide tube 12 as shown schematically in FIG. 1 serves to support the riser 5, in particular the lower, flexible part 7 of said riser, by means of a plurality of centering suppots or devices 16 which may be in the form of, e.g., centering devices. The bottommost such support comprises a fitted bushing 17 affixed to part 7 and glides on an interior bearing surface 18 of the elastic guide tube 12, thereby forming an aligned fitting for the part 7 on the lower part of guide tube 12. One of the supports 16*a* comprised of a centering device is disposed at the height of the lower guide 9*a* which is rigidly attached to the articulated structure 1 by the support means 10*a*.

The number of supports 16 mounted on the lower, flexible part 7 of the upright riser—i.e. between the fitted bushing 17 and the support 16*a*—is variable, depending on the length of the give part 7 and the characteristics of the materials employed for the tubular elements. The number of such supports 16 must allow for good transmission of the stresses from the riser to the elastic guide tube 12. When the length of part 7 is on the order of 30 m, advantageously it may be mounted using four regularly spaced centering devices; but this specification is not limitative.

The elastic guide tube 12 is supported against the lower guide 9*a* by means of a bushing 19 which slides on a polished interior bearing surface 20 of said lower guide 9*a*. This cylindrical bushing 19 has sufficient length to contact the polished interior annular bearing surface 20 of the guide 9*a* even when the articulated structure is inclined at substantial angles to the right or left.

When the elastic guide tube 12 is of the short type, as in FIG. 1, its length is such that regardless of the angle of inclination of the articulated structure 1, the bushing 19 is disposed interiorly to the polished annular part 20 of the lower guide 9*a*.

Figure 2:
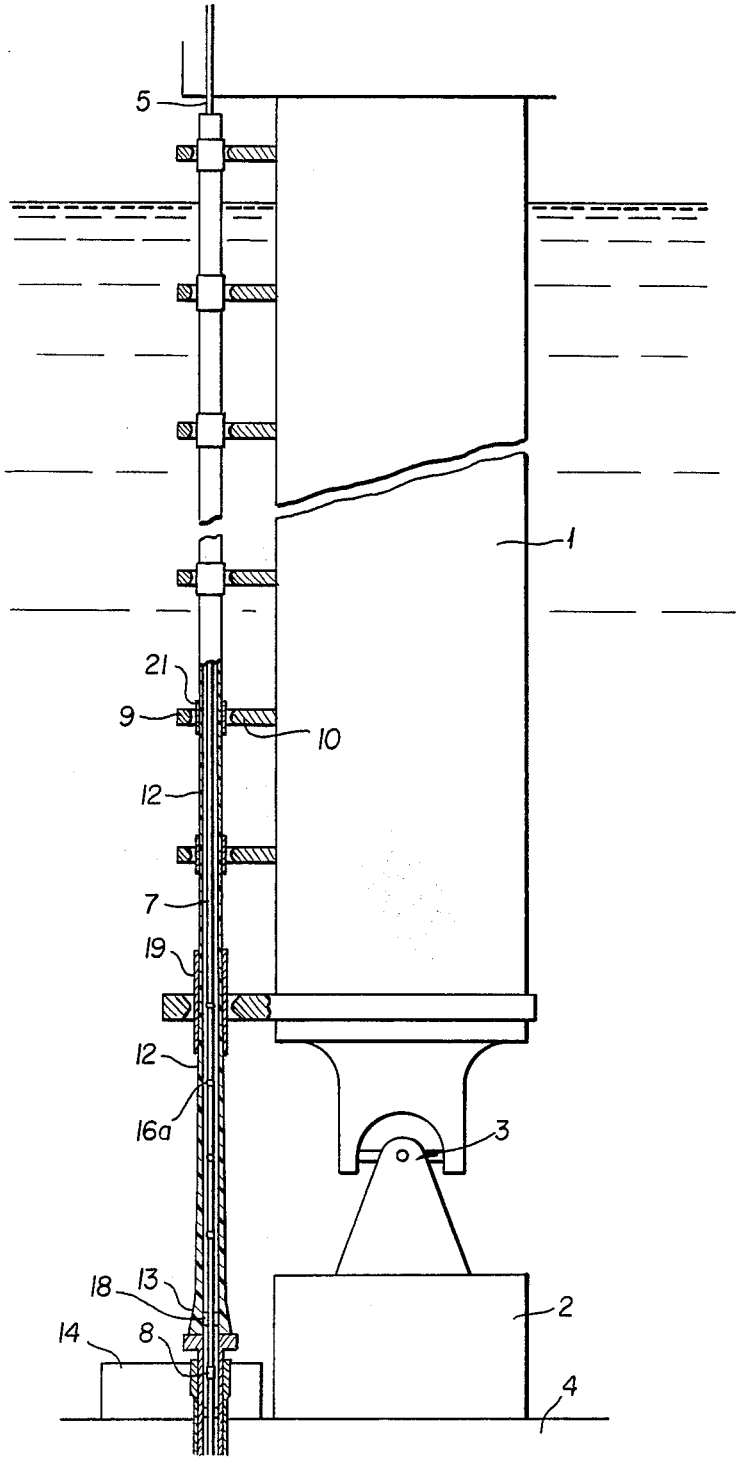
FIG. 2 shows an installation with a long guide tube.

When the elastic guide tube 12 is of the long type, as in FIG. 2, it extends upward for a distance greater than required as necessary and sufficient to assure that the bushing 19 is guided in the polished region 20, and indeed it may extend to the surface. The advantage of its extending to the surface is, among other things, that it may be filled with a fluid which provides good lubrication of surfaces which contact various supports 16 of the riser 5 on the guide tube 12. In this case the tube 12 constitutes an extension member of the casing 6, and can perform this function during drilling or restarting of well operation (i.e. workover), by techniques which are known and which will not be described here. The long guide tube 12 is then supported against the guides 9 by means of the support elements 21.

FIG. 3 shows how the elastic guide tube 12 is integrally joined to a drilling wellhead 15 by means of a connector 22, whereby the wellhead 15 is also integrally joined to a structure 14 usually called the "base plate", by means known in the art (not shown).

The conduit 6 is held centered in the wellhead tube by suspension means (not shown) and by seal means such as a ring 23 known in the art.

The upper part of the elastic guide tube 12 is generally of a thickness which allows it to flex under the influence of the movements of the lower part 7 of the riser 5, by the intermediary of the bushings 16. This thickness increases progressively toward the bottom, whereby in the lower part 13, in which the bushing 17 is moved, and down to the fitting provided by the connector 22, guide tube 12 is considerably rigid.

This thickness variation in the guide tube is the most practical means of attaining the required elasticity in the upper part of said tube along with the desired rigidity in the lower part of said tube. The thickness is varied very gradually, in order to avoid any locally abrupt change in the elastic properties.

Figure 4:
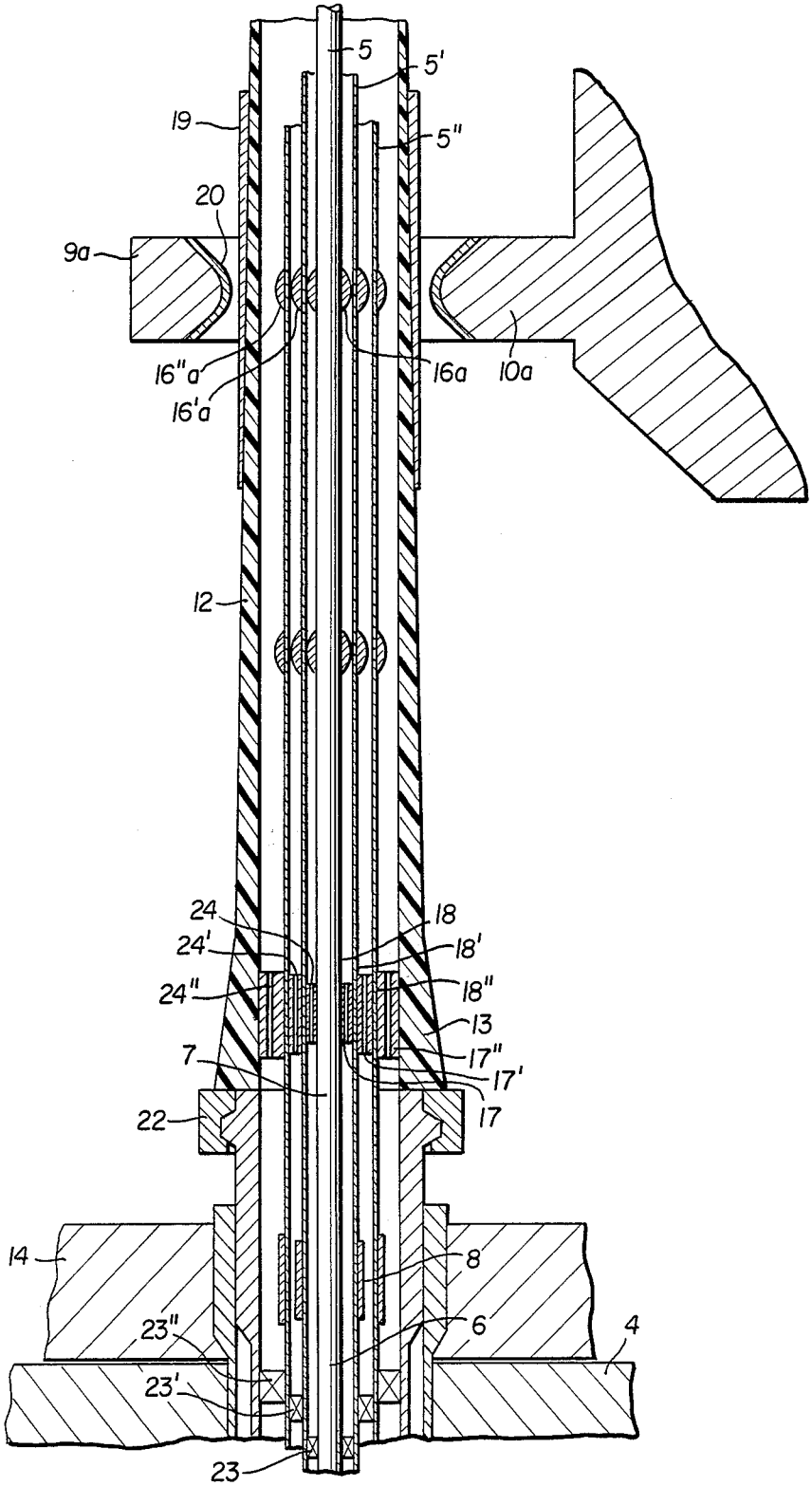
FIG. 4 shows an installation with a plurality of concentrically mounted columns.

FIG. 4 shows an installation comprising a plurality of flexible risers (e.g., 5, 5', 5'') in an embodiment utilizing a long elastic guide tube. These risers are supported against one another, and ultimately against the elastic guide tube, by means of centering devices (e.g., 16, 16', 16''), wherein the lowest centering device is comprised of fitted bushings 17, 17', 17'' which glide over interior bearing surfaces of the risers 18', 18'', and ultimately on an interior bearing surface of the elastic guide tube 12.

The elastic guide tube 12 is supported against the lowermost guide 9*a* by means of bushing 19. The centering devices 16 and 16', the bushings 17 and 17', and the rings 23 and 23' are furnished with pass-through openings 24, 24', 24'' for passing fluids through the respective annular passages. Other pass-through openings having a directional character may be installed in the bushings but; these are not shown.

MODE OF OPERATION OF THE NOVEL DEVICE

When the lower part of a flexible riser is disposed between a gliding guide in the lower end region of the articulated structure and an aligned fitting on the base plate, this lower part of the flexible riser becomes the recipient of substantial stresses transmitted to said riser during oscillations of the articulated structure.

With this inventive device, this lower part of the flexible riser is disposed in an elastic guide tube the lower part of which is furnished with means for conferring appreciable rigidity on said guide tube. Toward its bottom said guide tube is mounted on a base plate, and toward the top of said guide tube the guide tube is a guided by guide means rigidly attached to the articulated structure. This affords the desired mechanical advantage so as to provide support to said riser in its lower part, thus avoiding means of applying force to the riser at its head.

Further, with such a device, the riser is slidably mounted in the lower rigid region of the elastic guide tube, which mounting arrangement prevents flexure stresses from reaching the threaded junction region of the flexible riser on the producing pipe. These flexure stresses are instead transferred to the base plate, which enables preservation of the mechanical characteristics of the threaded region with the aim of facilitating future connections and disconnections.

The type of system described is not limited to installations with flexible risers disposed on articulated structures; and may be installed on any non-fixed structure. It may be employed for upright columns which pass fluids upward or downward, and also for a mechanical system for transmitting movement, e.g. drill stems undergoing forced rotation.

What is claimed is:

1. A stress-limiting device for at least one riser, which is an extension of a pipe rigidly attached to a base plate, whereby said riser is positioned in a set of guides, and the lower part of said riser is flexible; comprising:

a base structure positioned adjacent the base plate;

an elastic guide tube element the lower part of which includes means for providing substantial rigidity, wherein said guide tube is affixed to said base structure, and extends through at least a lower guide of said set of guides rigidly attached to the articulated structure, whereby said guide tube is disposed exteriorly of and coaxially to the riser;

a plurality of supports mounted on said articulated structure and connected to said guides, respectively, wherein said riser is aligned with said guide tube by means of said plurality of supports; and a fitted bushing positioned in the lower, rigid part of said guide tube and through which said riser extends.

2. A device according to claim 1, wherein the means for providing substantial rigidity to the lower part of the guide tube comprise a thickening of the guide tube with respect to the thickness in an upper part thereof.

3. A device according to claim 1, wherein the guide tube is of a length so as to be supported against the lower guide of said set of guides rigidly attached to the articulated structure independent of an angle of inclination of the articulated structure.

4. A device according to claim 1, wherein the base plate comprises a wellhead and wherein a lower end of the guide tube is connected to said wellhead.

5. A device according to claim 1, further comprising a plurality of centering devices positioned within said guide tube for centering said riser therein.

* * * * *